US006464835B1

(12) United States Patent
Räisänen et al.

(10) Patent No.: US 6,464,835 B1
(45) Date of Patent: Oct. 15, 2002

(54) EQUIPMENT AND METHOD IN A TWIN-WIRE FORMER

(75) Inventors: Kari Räisänen, Tampere (FI); Pasi Virtanen, Valkeakoski (FI); Sakari Soini, Somero (FI); Kimmo Penttilä , Tampere (FI); Kari J. Salminen, Ylinen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/807,639

(22) PCT Filed: Oct. 8, 1999

(86) PCT No.: PCT/FI99/00837

§ 371 (c)(1),
(2), (4) Date: Jul. 30, 2001

(87) PCT Pub. No.: WO00/23649

PCT Pub. Date: Apr. 27, 2000

(30) Foreign Application Priority Data

Oct. 16, 1998 (FI) ..... 982245

(51) Int. Cl.[7] ..... D21F 1/00; D21F 1/56

(52) U.S. Cl. ..... 162/203; 162/301; 162/334; 162/353

(58) Field of Search ..... 162/203, 300, 162/301, 334, 353

(56) References Cited

U.S. PATENT DOCUMENTS 4,124,441 A 11/1978 Nykopp ..... 162/301
5,302,250 A 4/1994 Peterson et al. ..... 162/353
5,795,442 A * 8/1998 Boyd et al. ..... 162/353
5,851,356 A * 12/1998 Banning et al. ..... 162/353

FOREIGN PATENT DOCUMENTS

FI 760291 8/1979

* cited by examiner

*Primary Examiner*—Karen M. Hastings
(74) *Attorney, Agent, or Firm*—Steinberg & Raskin, P.C.

(57) ABSTRACT

The invention concerns an equipment and a method in a twin-wire former, in which a partly pre-drained or non-drained fiber stock is passed to between the forming wires of the web former in the vicinity of the former roll (11) or of a water drain box, in which connection water is drained out of the stock web by means of the former roll (11) or the water drain box. The twin-wire former comprises a rib (20) in connection with the former roll (11) or the water drain box in the lateral area of the wires ($H_2$), which rib has been fitted to control the running of the second forming wire $H_2$) passed from the gap roll. By means of the rib (20), in the lateral area of the wire runs, the point at which said forming wire ($H_2$) reaches contact with the first forming wire in connection with the former roll (11) or the water drain box is shifted further away in the machine direction. The rib (20) is an oblong structure, which has a maximal height ($H_{max}$) in the middle area of the rib (20).

15 Claims, 11 Drawing Sheets

EQUIPMENT AND METHOD IN A TWIN-WIRE FORMER

FIELD OF THE INVENTION

The invention concerns an equipment and a method in a twin-wire former of a board machine or of a paper machine in view of controlling the edge effect.

BACKGROUND OF THE INVENTION

In gap formers, the web is formed by, out of the headbox, feeding a fibrous stock into a gap formed by two wires. The gap formed by the wires is substantially wider than the slice jet discharged from the headbox. When the jet arrives in the gap, the wires are placed apart from each other in the area of the jet, but the wires tend to enter into contact with each other as the draining proceeds in the lateral areas. In the lateral area, in the cross direction, the thickness of the jet does not go to zero steeply, but gently (FIG. 1B), When the web is being formed, water is drained out of it by the effect of pressure p=T/R. In the initial stage, when a fibrous mat has not yet been formed to a significant extent, the rate of draining of water is considerable. In this connection, the draining of water takes place in the direction of thickness of the web. When a fibrous mat is formed, the rate of draining becomes slower. In such a case, the flow in the lateral area of the jet tends to turn towards the side owing to the reduction of the cross-directional face defined by the wires. The flow can take place either inwards or outwards. As a result of this, great divergencies from a machine-direction fibre orientation can be seen clearly in the lateral area. This comes out in particular when large slice openings and poorly drainable stock grades are used.

The present invention concerns a method for control and elimination of the detrimental edge effect in a twin-wire web former and in particular in a gap former. The method can also be used for regulation of orientation angles and basis weights in the lateral areas of the stock web, and, thus, it is also suitable for a method of regulation of the cross-direction profiles of the web.

In Fourdrinier machines, at the edges of the web, deckle boards and edge raising means are employed in order that the stock suspension should not flow over the edge of the wire. In gap formers, such devices for the lateral areas have not been needed, because, typically, small slice openings and/or quickly draining stocks have been used. But the problem of the lateral area is also present in gap formers. It is a feature common of Fourdrinier and gap concepts that, when the slice openings at the headbox become larger, the problems in the lateral areas are emphasized.

Figure 1A is a side view of the slice jet and the initial draining area in a gap former. The covering wire has been illustrated to be straight and tangential to both rolls in the figure, and right at the edge of the wire, where there is no stock web between the wires, the situation is indeed similar to what is shown. FIG. 1B is a sectional view taken along the line I—I in FIG. 1A. It is seen from the figure that at the edges the covering wire and the lower wire are in contact with one another. In the middle area of the stock web, the covering wire and the lower wire are placed apart from one another, because the web is between them. Between the middle area and the wire edges, there is an area in which the wires approach each other. The edge of the stock web is placed in this area.

Since the. edge effect described above is emphasized in the area in which the draining of water and the web formation have proceeded rather far, it affects the properties of the fibre mat that is formed. At the edges of the web the basis weight is lower than in the middle of the web. Also, the orientation angles are different in the lateral areas of the web, as compared with the middle. True enough, the edges of the web are trimmed off in a later stage of the process, but, when a large slice opening is used, the effects of the edge effect extend to a portion of the web that is not trimmed off. On the other hand, the smaller the portion that is trimmed off, the more cost- efficient can the process be made.

OBJECTS AND SUMMARY OF THE INVENTION

As a solution for the problem described above, a method is described by whose means the covering wire is raised apart from the lower wire, and, at the same time, carriage of the stock suspension away from between the wires over the web edges is prevented.

In accordance with the invention, in view of minimizing and controlling the effects of the edge effect, in the present patent application, it is suggested that, in the twin-wire area, an arrangement of equipment in particular connected with the former roll be employed, by means of which arrangement the point of coming together of the forming wires in the edge area is transferred further on the former roll, i.e. in the present invention the area of draining is extended in which the webs are still placed apart from one another. Thus, when the wires reach contact with each other, the web has already had time to be drained enough in the edge area, and, thus, no problems of fibre orientation or basis weight occur.

In the present patent application, it is suggested that such an arrangement of equipment be employed in which a rib extending to the lateral area of the web is used. The position of the rib can be regulated by means of adjustment devices both in the machine direction and in the cross direction of the machine. In this way it is possible to regulate the position of the rib in relation to the former roll, and, thus, it is possible to regulate a controlled reaching of contact between the wires.

BRIEF DESCRIPTION OF THE DRAWINGS

The invention will be described in the following with reference to some preferred embodiments of the invention, the invention being, however, not supposed to be confined to said embodiments alone.

FIG. 2A shows a rib in accordance with the invention to be fitted at an edge of the machine. The illustration is axonometric.

DETAILED DESCRIPTION OF THE INVENTION

Figure 1A:
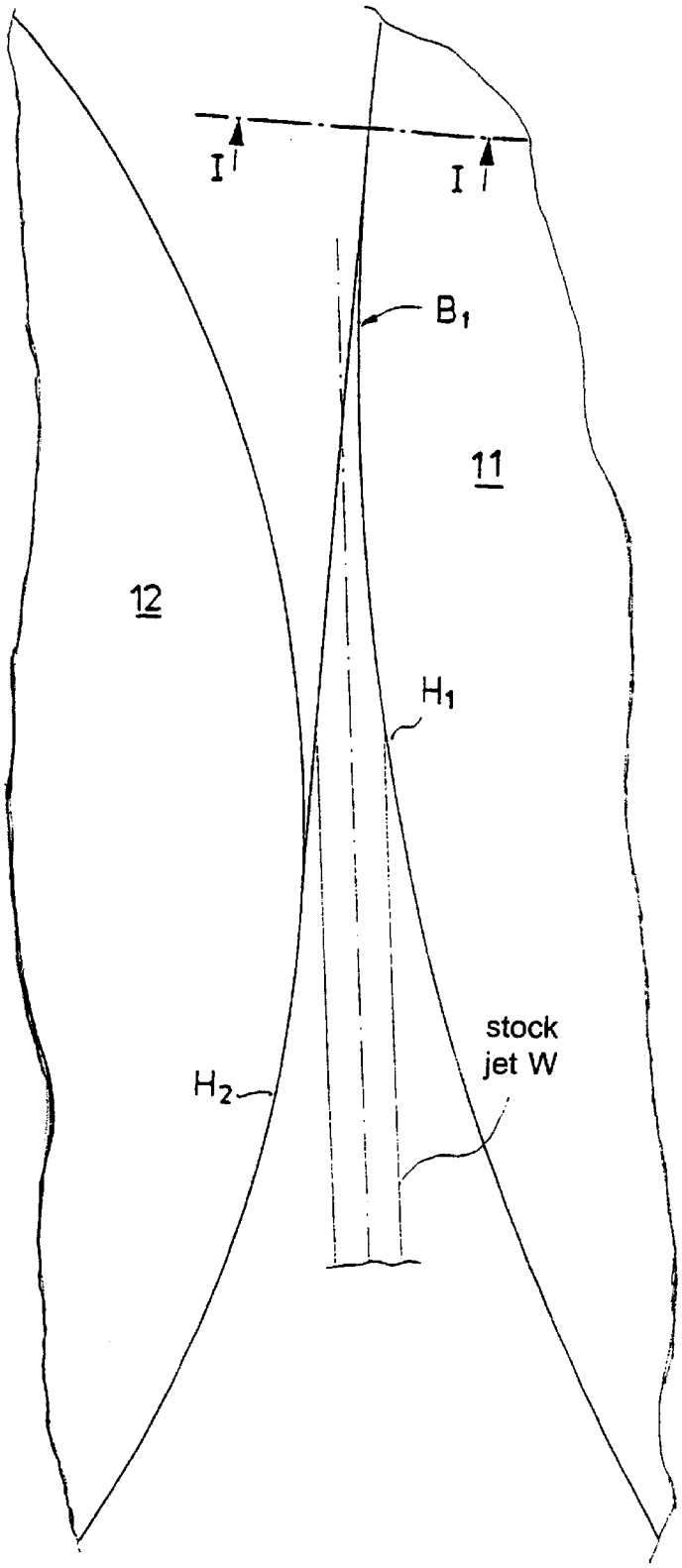
FIG. 1A illustrates the target area of the present invention in connection with the former roll of a gap former.

FIG. 1A illustrates the target area of the invention in connection with the former roll 11 and the gap roll 12 in a twin-wire web former 10 in a board machine or paper machine. The twin-wire former in the embodiment shown in the figure is a gap former. The first, forming wire $H_1$ runs on the face of the former roll, and the second forming wire $H_2$, i.e. the covering wire, is guided onto the face of the former roll from the gap roll 12 or reversing roll. The wires $H_1$, $H_2$ reach contact with each other in the area B. in the way shown in FIG. 1A. The stock jet W is passed into the gap between the forming wires $H_1$ and $H_2$ in the way shown in FIG. 1A.

In a twin-wire former, such as a gap former, the web is formed so that fibrous stock is fed from the headbox into a gap formed by two wires. The gap formed by the wires is substantially wider than the slice jet discharged from the headbox. In the initial stage, when a fibre mat has not yet been formed to a significant extent, the rate of draining of water caused by the dynamic pressure is considerable. At this stage, no detrimental transverse flows arise as yet. When proceeding in the machine direction, with the exception of the lateral areas, the wires are placed apart from each other at a distance determined by the thickness of the fibre mat. In the lateral areas the wires attempt to reach contact with each other by the effect of the tension of the wire. When running with large slice openings, it is also necessary to-press the edges into contact with each other by means of separate sealing members. When a fibre mat is formed, the rate of draining of water becomes lower. In such a case, the flow in the lateral area tends to turn towards the middle of the web, owing to the reduction of the cross-sectional area formed by the wires. As a result of this, great divergencies from a machine-direction fibre orientation can be seen clearly in the lateral area. This comes out in particular when large slice openings and poorly drainable stock grades are used. The essential features in what has been stated above are: A divergence of orientation from the machine direction occurs when the slice opening becomes larger, and a divergence of orientation arises at the earliest at a point at which a dewatering pressure has been formed inside the web. During initial dewatering, no pressure occurs, because of the low resistance to draining. Nor do cross-direction flows arise to a significant extent in a later stage if the rate of draining of water out of the web is sufficiently high. This can be concerned with low basis weights and with rapidly draining stock grades.

Figure 1B:
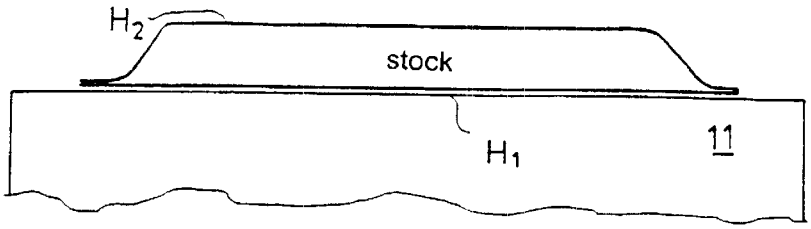
FIG. 1B is a sectional view taken along the line I—I in FIG. 1A.

FIG. 1B illustrates the problem that occurs in a prior-art solution with a large slice opening. The figure illustrates a lateral area of the web at which the variation of the orientation angle is large. Said problem does not occur with small slice openings of the headbox.

FIG. 1B is a sectional view taken along the line I—I in FIG. 1A. As is shown in FIG. 1B, the stock suspension remains in the area between the forming wires $H_1$ and $H_2$ also without separate edge guides or edge limiters, because the wires $H_1$ and $H_2$ reach contact with each other at the edges. However, said area of contact $B_1$ between the wires $H_1$ and $H_2$ in FIG. 1A causes problems. If the stock has not had time to be drained adequately in said lateral areas, the fibres tend to be oriented detrimentally away from the machine direction, owing to the change in the area between the wires. In order to avoid said edge effect, in the present patent application it is suggested that an arrangement be used in which. the covering wire is guided by means of a separate rib placed at the edge into connection with the forming wire $H_1$ so that the draining area in connection with the former roll is increased and, thus, the point of contact between the wires is shifted in the lateral areas further in the machine direction. By means of said arrangement, the stock has had time to be drained and, thus, when the wires reach contact with each other, corresponding faults of alignment do not arise in the fibre orientation, nor are detrimental great divergencies then noticed in the basis weight of the web in the direction of width of the machine.

Figure 1C:
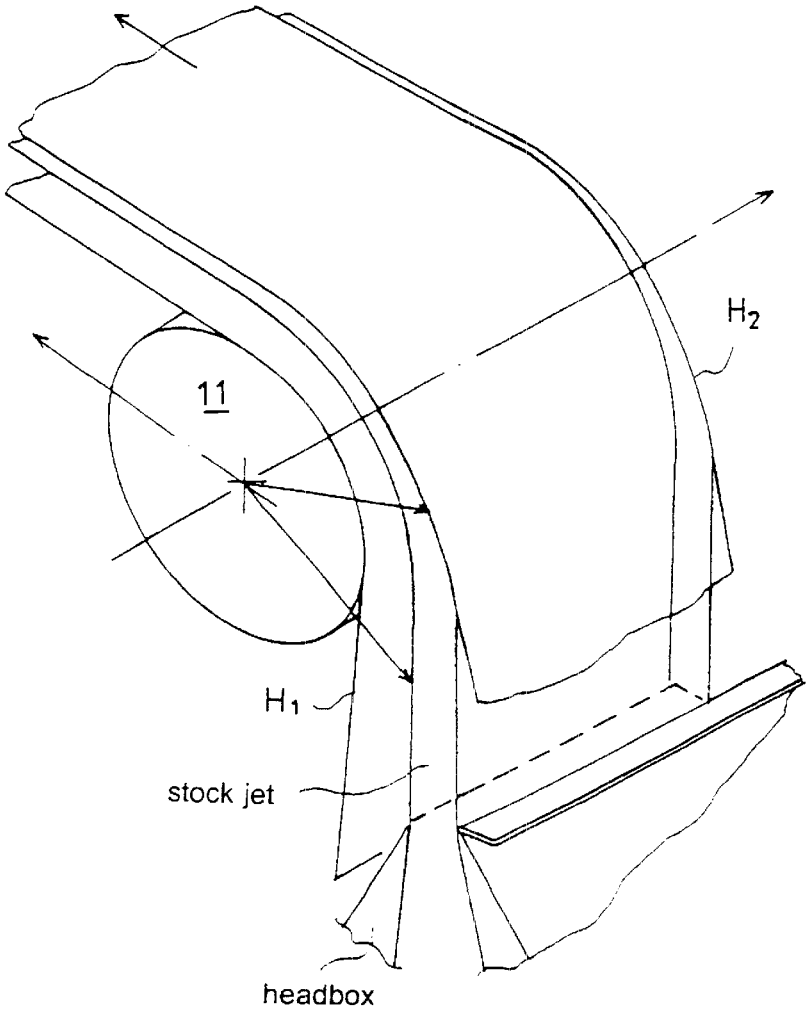
FIG. 1C illustrates the running of the wires $H_1$ and $H_2$ in a prior-art construction.

FIG. 1C illustrates the running, of the wires $H_1$ and $H_2$ in connection with the former roll in a gap former.

Figure 2A:
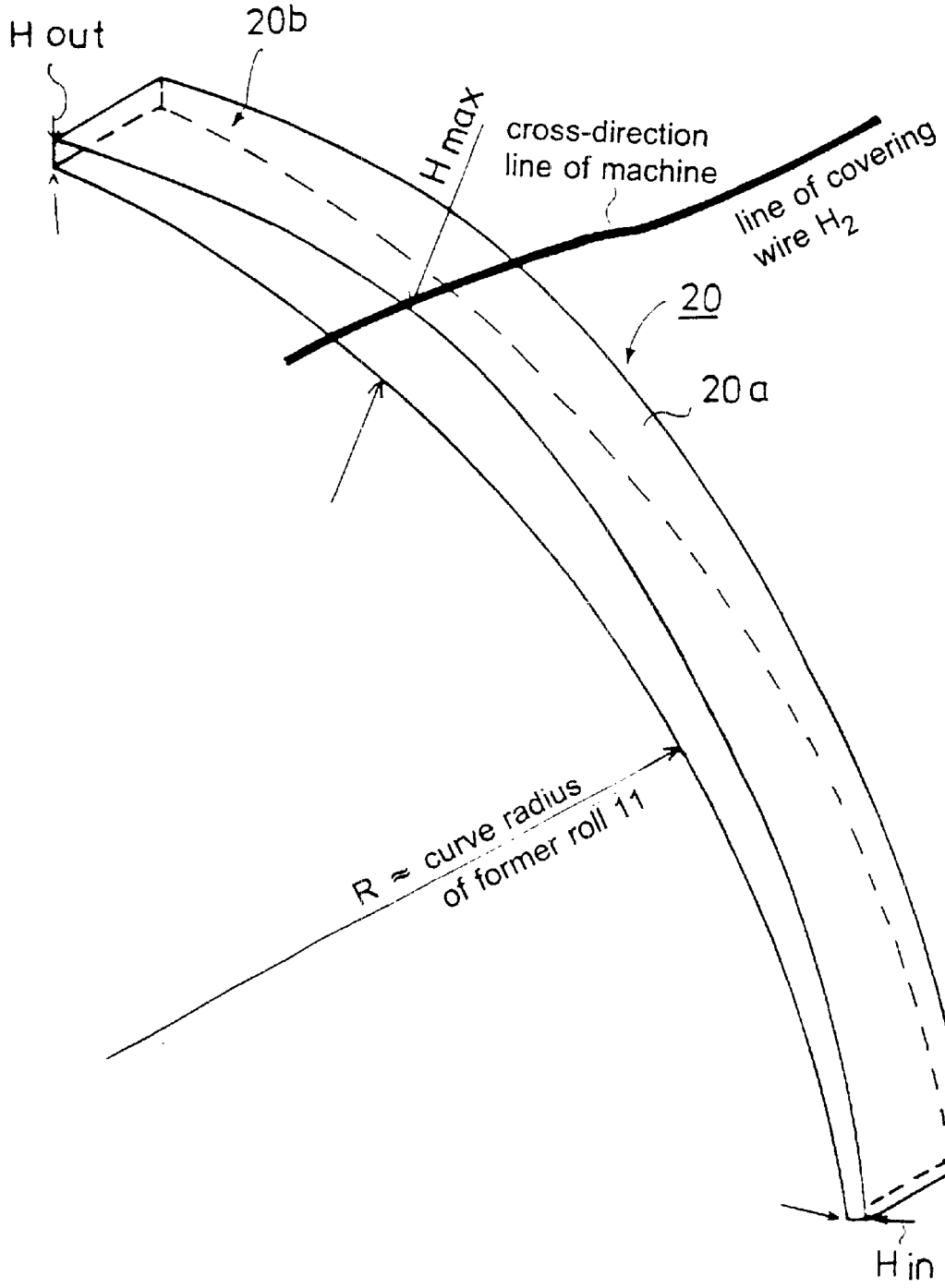
FIG. 2A illustrates the solution in accordance with the invention for the problem illustrated in FIGS. 1A and IB.

FIG. 2A illustrates a. solution in accordance with the invention. The problem mentioned above can be solved as follows. It is essential that, after formation of a drainage pressure, attempts are made to keep the distance between the wires in the lateral area equal to the thickness of the web that has been formed. This can be accomplished as follows. To the area of the gap, between the wires, at the edges, a rib 20 is added, which becomes thicker in the initial part when proceeding in the machine direction, and which becomes thinner after the thickest portion. This is to say that the middle portion of the rib 20 is substantially thicker than the initial end and the final end. The piece must be thin in the initial stage in order that the running of the wires $H_1$ and $H_2$ should not be hampered or cause significant wear both in the wire and in the piece itself. Of course, the initial stage does, however, not affect the formation of the fault in the orientation. The thickest portion of the rib 20 must be placed approximately at the point at which a drainage pressure has been formed. After this the rib 20 becomes thinner roughly in compliance with the rate at which the web becomes thinner. The rib must extend in the machine direction far enough in the running direction of the wire so that a possible transverse flow can no longer position the fibres. The thickness of the thickest portion of the rib 20 is preferably 5 to 30 mm. The thickness of both ends of the rib 20 is 1 to 5 mm. The position of the rib 20 can be regulated both in the cross direction of the machine and in the horizontal direction. Optimally, the distance of the side edge of the rib in the cross direction is −50 mm to +50 mm in relation to the edge of the slice jet, i.e. to the nearest edge of the piece concerned. When the distance is altered, the fibre orientation can be affected. The inlet end of the rib 20 is denoted with Hin. The position of maximal height of the rib is denoted with $H_{max}$, and the outlet end of the rib is denoted with $H_{out}$. The inlet end refers to the point at which the wire arrives at the rib, and the outlet end refers to the point at which the wire departs from the rib.

In the equipment, the position in the running direction of the wires is such that the starting point of the rib is at the earliest in the area $B_1$ in which the wires reach contact with each other, and the final point is at the latest where the thickness of the web is less than 1 mm.

In accordance with the invention, when the rib is formed in the way described herein, a smooth introduction of the covering wire into connection with the rib is permitted, and a necessary drainage area determined by the rib height is formed in the middle area of the rib, from where the rib height is reduced to the minimum $H_{out}$. The curve radius of the bottom face of the rib 20 corresponds to the curve radius R of the former roll when the water drain unit is a former roll 11.

The position of maximal height $H_{max}$ of the rib is placed in the middle area of the rib. In such a case, it is placed in the area between the inlet end $H_{in}$, of the rib 20 in and the outlet end $H_{out}$, of the rib, in which connection the thickness of the rib increases when proceeding from the inlet end $H_{in}$ of the rib to the position of maximal height $H_{max}$ of the rib, and the thickness of the rib becomes smaller when proceeding from the position of maximal height $H_{max}$ of the rib to the outlet end $H_{out}$ of the rib.

The rib 20 is made of a wear-resistant material of low friction, such as HDPE or a metal.

A rib 20 in accordance with the invention can be used, in general, in connection with twin-wire web formers in board or paper machines. In such a case, the stock suspension W is passed after the headbox 100 of the board or paper machine into the gap between the forming wires $H_1$, $H_2$ a water drain unit, such as a former roll or a water drain box, being placed in the vicinity of said gap. The ribs 20 are fitted both lateral areas between the forming wires $H_1$, $H_2$. The invention is suitable for application in particular in connection with a gap former, which comprises a former roll or, in stead of a former roll, a water drain box, such as a ribbed box or a suction box. The invention is also well suited for application in connection with a what is called hybrid former, in which, before the gap between forming wires, there is a what is called water pre-drain unit in connection with one of the forming wires, which pre-drain unit is favourably a water drain box.

Figure 2B:
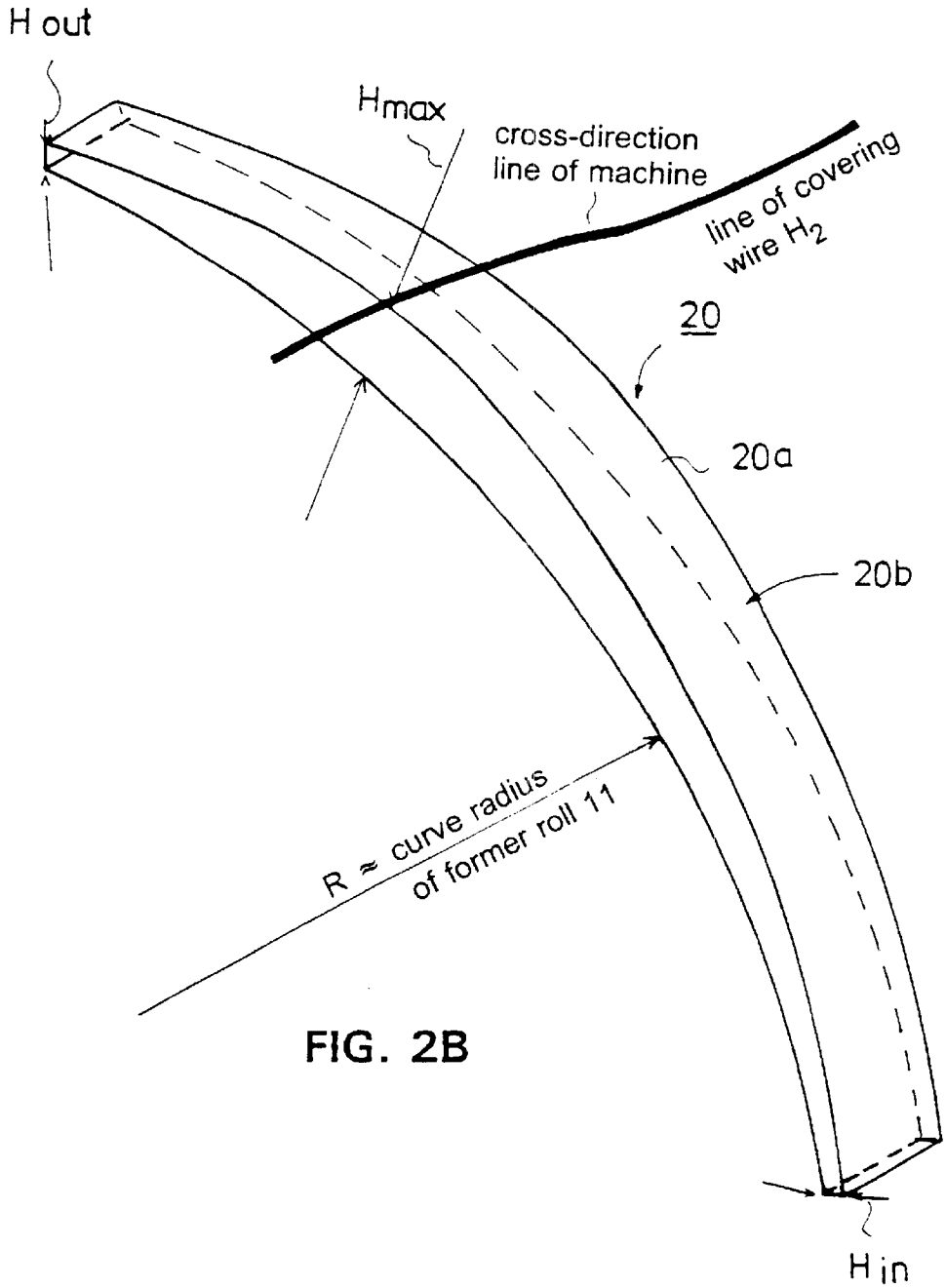
FIG. 2B shows a second embodiment of the rib in accordance with the invention, in which the rib becomes narrower when proceeding in the machine direction from the headbox.

In FIG. 2B, the rib 20 has been shaped so that the distance of the inside edge of the rib 20 from the wire edge becomes shorter when proceeding in the machine direction, in which connection wire is exposed on which no fibre mat has been formed as yet. Owing to reduced resistance to draining of water, the flow attempts to flow in this direction. The pieces can be turned to a certain angle in relation to the machine direction. When the final end is turned outwards, wire is exposed on which no fibre mat has been formed. In such a case, the flow attempts to flow towards the edge of the web because of the reduced resistance to draining of water. The fibre orientation can be influenced by means of the magnitude of this turning.

Within the scope of the invention, an embodiment is possible in which the rib 20 becomes wider in the machine direction. In such a case, the fibre orientation angle is affected in the opposite direction.

Figure 2C:
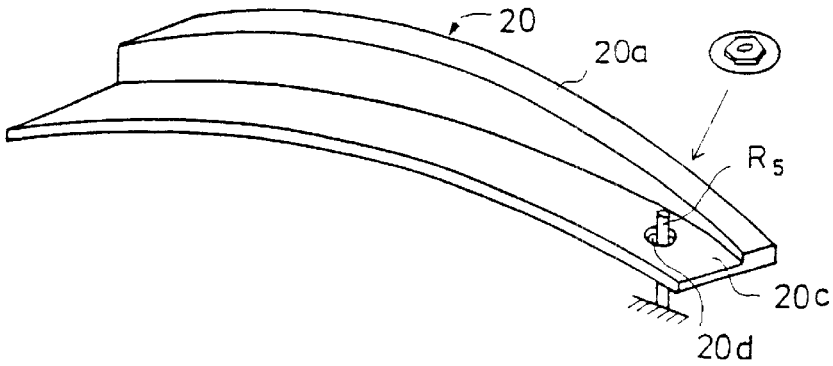
FIG. 2C illustrates a solution of regulation of the rib. The rib can be regulated and positioned both in the running direction of the wire and in the cross direction.

As is shown in FIG. 2C, the rib 20 can also be shifted both in the machine direction and in the cross direction of the machine, in which case it is possible to set the location of the thickest portion of the rib 20. This is done because, depending on the stock grade and on the slice opening, the place of formation of the water drain pressure varies in the machine direction. The figure shows an embodiment in which the rib 20 comprises an opening 20*d* in its edge 20*c*, through which opening a fastening screw R5 has been passed. The opening 20*d* has been made wide in relation to the diameter of the screw R5, in which case the rib 20 can be adjusted both in the running direction of the forming wire in the paper or board machine and also in the direction transverse to the running direction of the wire.

Figure 2D:
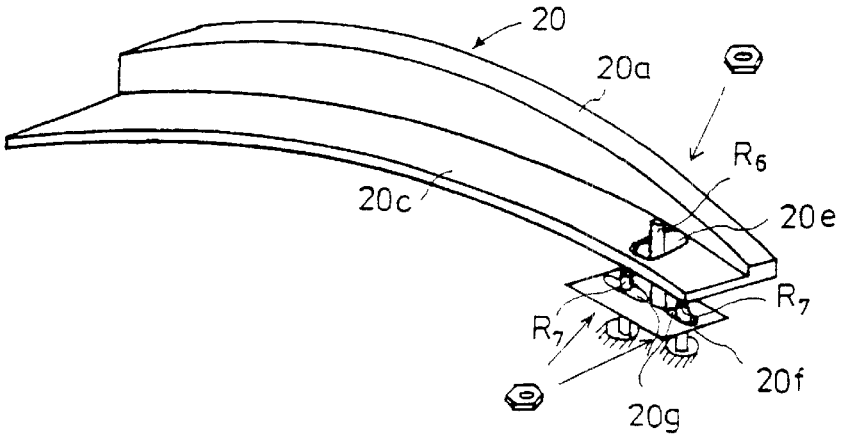
FIG. 2D illustrates a solution for regulation of the position of the rib 20 both in the machine direction and in the cross direction in view of regulation of the position of the rib.

FIG. 2D shows an embodiment of regulation, in. which the screw R6 has been passed into the rib 20 through a cross-direction hole 20*e* in the edge 20*c*.The screw R6 has been connected to a base plate 20*f*, which comprises openings 20*g* placed in the running direction of the wire, through which opening the screws R7 connected to the machine. frame have been passed. In this way the rib 20 can be regulated both in the running direction of the wire and in the direction transverse to the running direction of the wire.

Figure 2E:
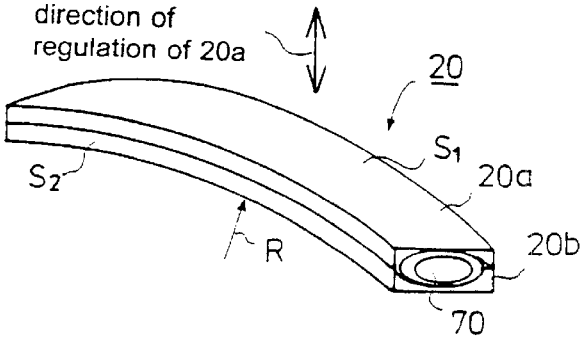
FIG. 2E shows an embodiment of the invention in which the rib has been made of lamellae, an actuator, favourably a pneumatic hose, being fitted in the space between said lamellae so as to regulate the shape of the height profile of the rib as desired.

As is illustrated in FIG. 2E, the thickness of the rib 20 can be regulated, for example, by means of pneumatic loading or water, loading by means of an actuator 70, such as a loading hose. The rib 20 can also be made of a resilient material, in which case it can also be regulated by compressing. The rib 20 can also consist of lamellae $S_1$, $S_2$ displaceable in relation to one another, in the way shown in FIG. 2E.

The actuator 70 can be a loading hose which is composed of component hoses, in which case, by means of said actuator, the position of the maximal height $H_{max}$ of the rib can be altered over the length of the rib. At the same time, said height $H_{max}$ can also be altered by choosing the pressure in the loading hose appropriately.

Figure 2F:
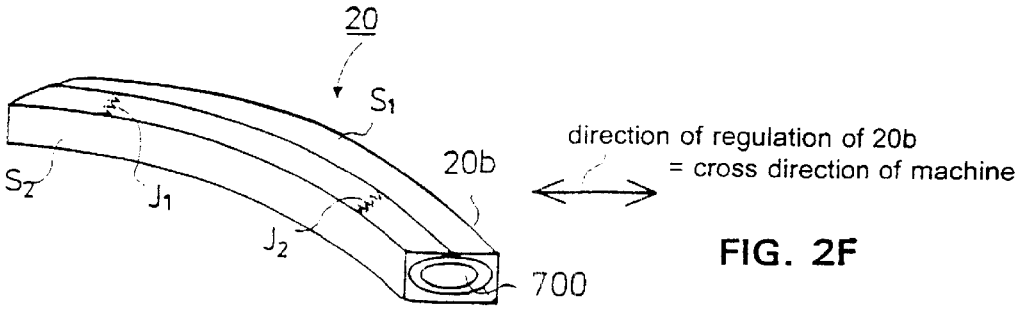
FIG. 2F shows an embodiment of the invention in which the side face 20*b* of the rib can be positioned by means of an actuator, favourably a loading hose.

FIG. 2F is an illustration of principle of the regulation of a resilient rib 20 in the cross direction of a board or, paper machine by means of an actuator 700. The actuator is a loading hose. The springs $J_1$,$J_2$ . . . produce a counter force for the loading hose. The rib 20 may consist of lamellae $S_1$ and $S_2$ In the embodiments shown in FIGS. 2D and 2E, the actuator 70 and 700 is a loading hose, for example, filled with compressed air or with a liquid. In stead of a loading hose, it is also possible to use other actuators, such as hydraulic cylinders, an electric actuator, etc. When actuators are employed, they can be distributed over the length of the rib so that, by their means, the faces 20*a* and 20*b* of the rib can be given the desired curve form/position, and in this way it is possible to shift the position of maximal height $H_{max}$ of the rib in the desired way in compliance with each run.

Figure 3:
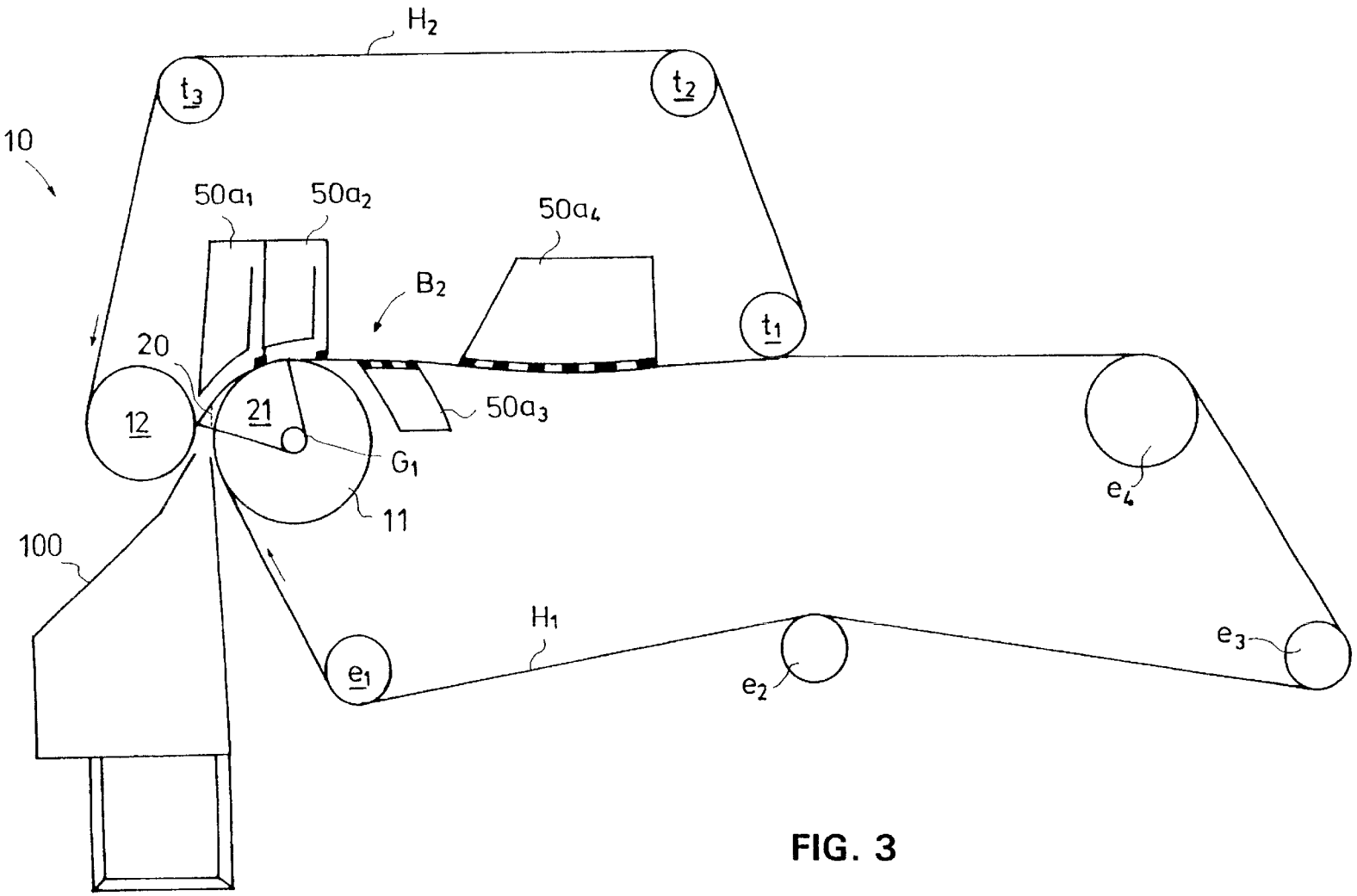
FIG. 3 shows a former construction with which the guide in accordance with the invention and connected with the former roll has been connected.

FIG. 3 shows a gap former 10 of a board or paper machine, which former comprises a guide 20 in accordance with the invention in connection with the former roll. The illustration is a side view. As is shown in the figure, the gap former 10 comprises a first forming wire $H_1$, which has been passed over reversing rolls and guide rolls $e_1$, $e_2$ . . . and over the former roll 11, as well as a second forming wire $H_2$, i.e. a covering wire, which has been passed over reversing rolls $t_1$, $t_2$ . . . and over the gap roll 12. The forming wire $H_2$, which is also called covering wire, has been passed from the gap roll 12 into connection with the first forming wire $H_1$ guided on the former roll. Thus, over a certain distance, the forming wire $H_1$ and the covering wire $H_2$ have a joint run on the face of the former roll 11. From the headbox 100, a stock jet is passed into the gap between the wires $H_1$ and $H_2$. The water drain units are denoted with the reference numerals 50$a_1$, 50$a_2$, 50$a_3$, and 50$a_4$. In an embodiment of the present invention, the former roll 11 may comprise inner vacuum zones or suction zones or one suction zone, in which case water is drained out of the stock web on the suction zone and through the perforation in the former roll. The former roll can also be a perforated roll which does not include an inside suction box. In accordance with the invention, there is a rib 20 in accordance with the invention connected to the axle of the former roll, which rib comprises a support arm 21, with which the rib 20 is connected through a fastening frame 23. By means of the rib, the arrival of the forming wire $H_2$, i.e. of the covering wire, into connection with the forming wire proper $H_1$ running on the former roll 11 is regulated.

By means of the rib 20, the running of the covering wire $H_2$ is controlled so that it meets the forming wire $H_1$ running on the former roll further away than would be the case without said arrangement of equipment. In this way the area of free draining on the face of the former roll 11 is extended. A guide 20 is placed in each lateral area of the machine.

Figure 4A:
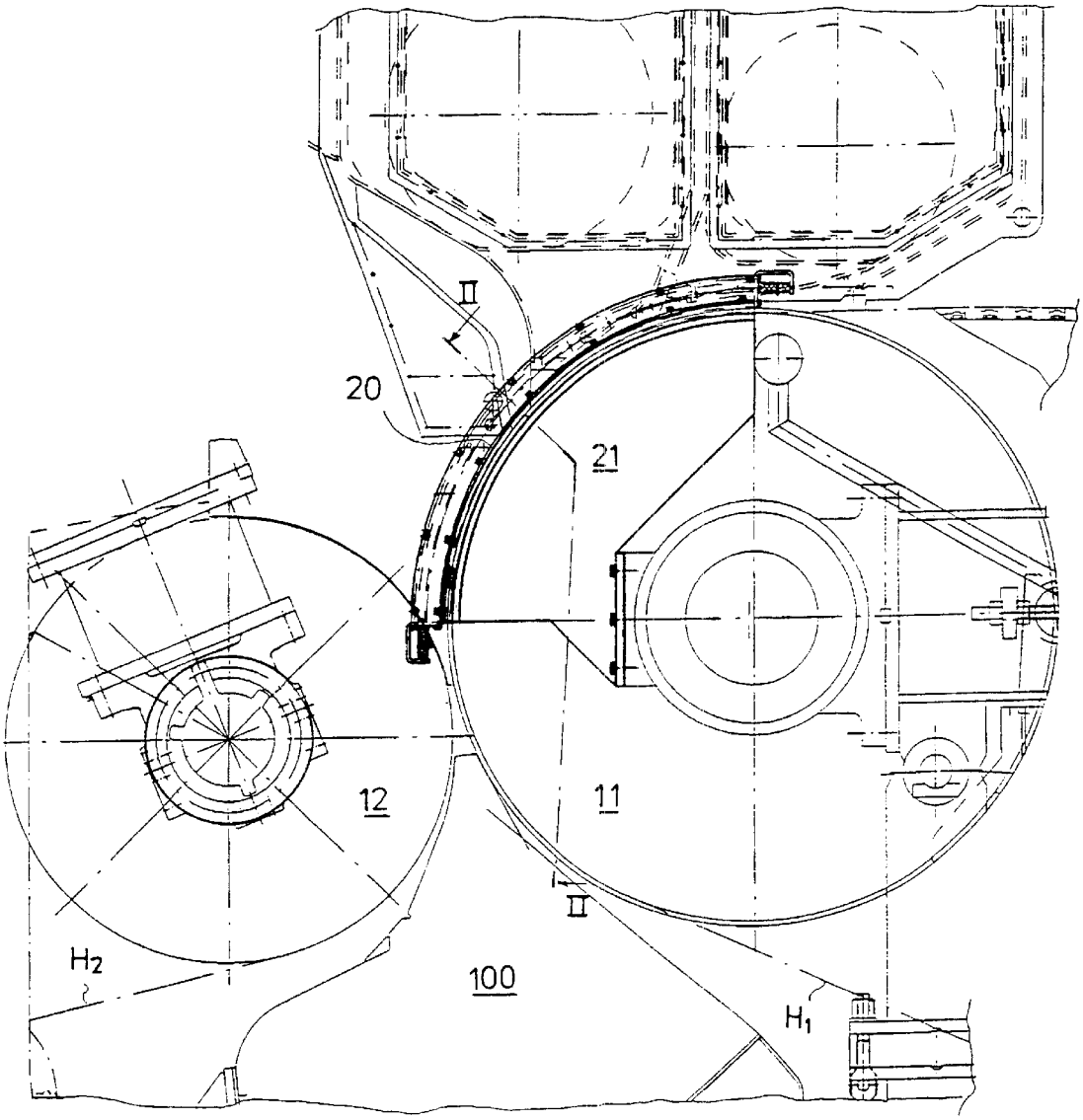
FIG. 4A shows a solution of equipment in accordance with the invention in connection with a former roll. The illustration is from the area $B_2$ in FIG. 3.
Figure 4B:
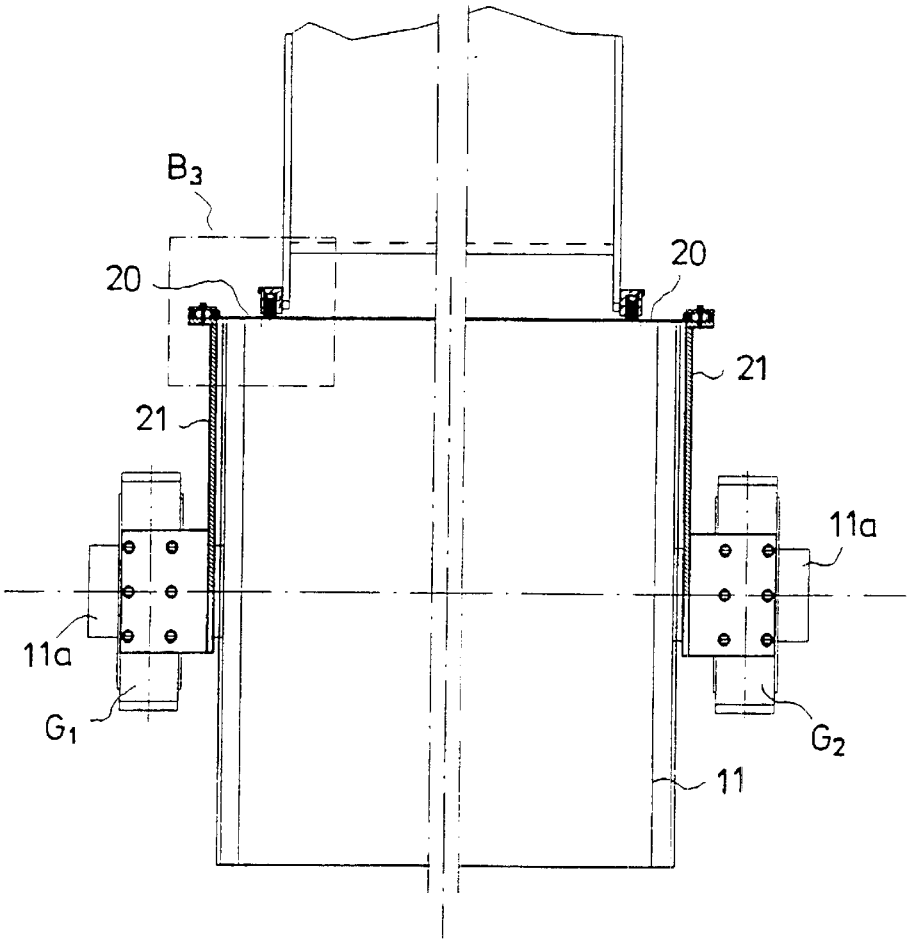
FIG. 4B is a sectional view of the equipment taken along the line II—II in FIG. 4A.
Figure 4C:
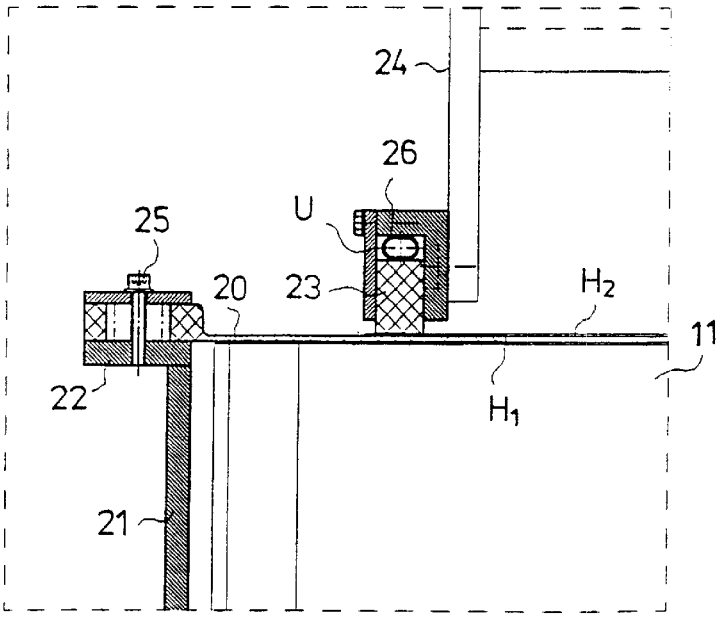
FIG. 4C illustrates the area $B_3$ from FIG. 4B in an enlarged scale.

FIG. 4A is a more detailed illustration of the target area $B_2$ of the invention shown in FIG. 3. FIG. 4B is a sectional view taken along the line II—II in FIG. 4A, and FIG. 4C illustrates the area $B_3$ in FIG. 4B in an enlarged scale. The rib 20 is connected with the bearing housing $G_1$ of the former roll 11 or with the axle 11*a* of the former roll 11 by the intermediate of a support arm 21. The arrangement is identical both at the tending side and at the driving side of the machine. The seal 23 is pressed by means of a loading hose 26 with a pressure towards the rib 20 in accordance with the invention so that the wire $H_2$ is pressed by the seal.

By means of a screw 25, the rib 20 can be positioned and attached to the fastening frame 22 connected with the support arm 21. The displaceable seal 23 is placed in a groove U in the upper frame 24, and the seal is pressed by means of a loading, hose 26 so that the covering wire $H_2$ is placed against the face 20*a* of the rib 20 and complies with its shape.

Figure 4D:
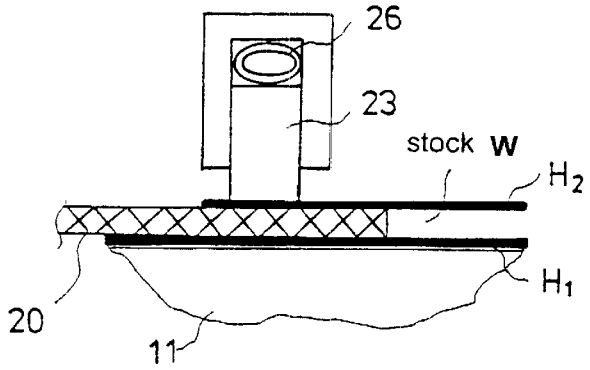
FIG. 4D illustrates the area $B_3$ from FIG. 4A in an enlarged scale.

FIG. 4D is an enlarged illustration of the area $B_3$ in FIG. 4B.

Figure 5A:
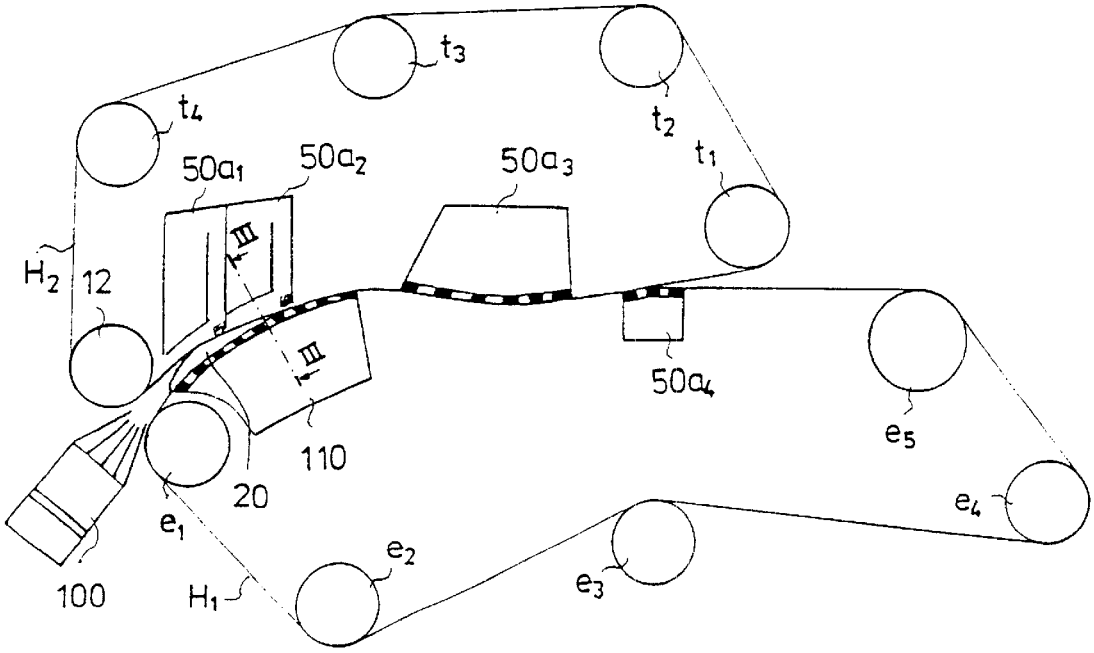
FIG. 5A illustrates the use of an equipment in accordance with the invention in connection with a water drain box (110).

FIG. 5A shows a solution of equipment 20 in accordance with the invention in connection with a gap former in which the former roll 11 has been substituted for by a water drain box (110).

The water drain box 110 can be a water drain box into whose interior chamber a vacuum is applied, and so a suction is applied through the set of ribs on the water drain box further to the stock web, or the water drain box can also be a simple box construction provided with a set of ribs but with no inside vacuum.

Figure 5B:
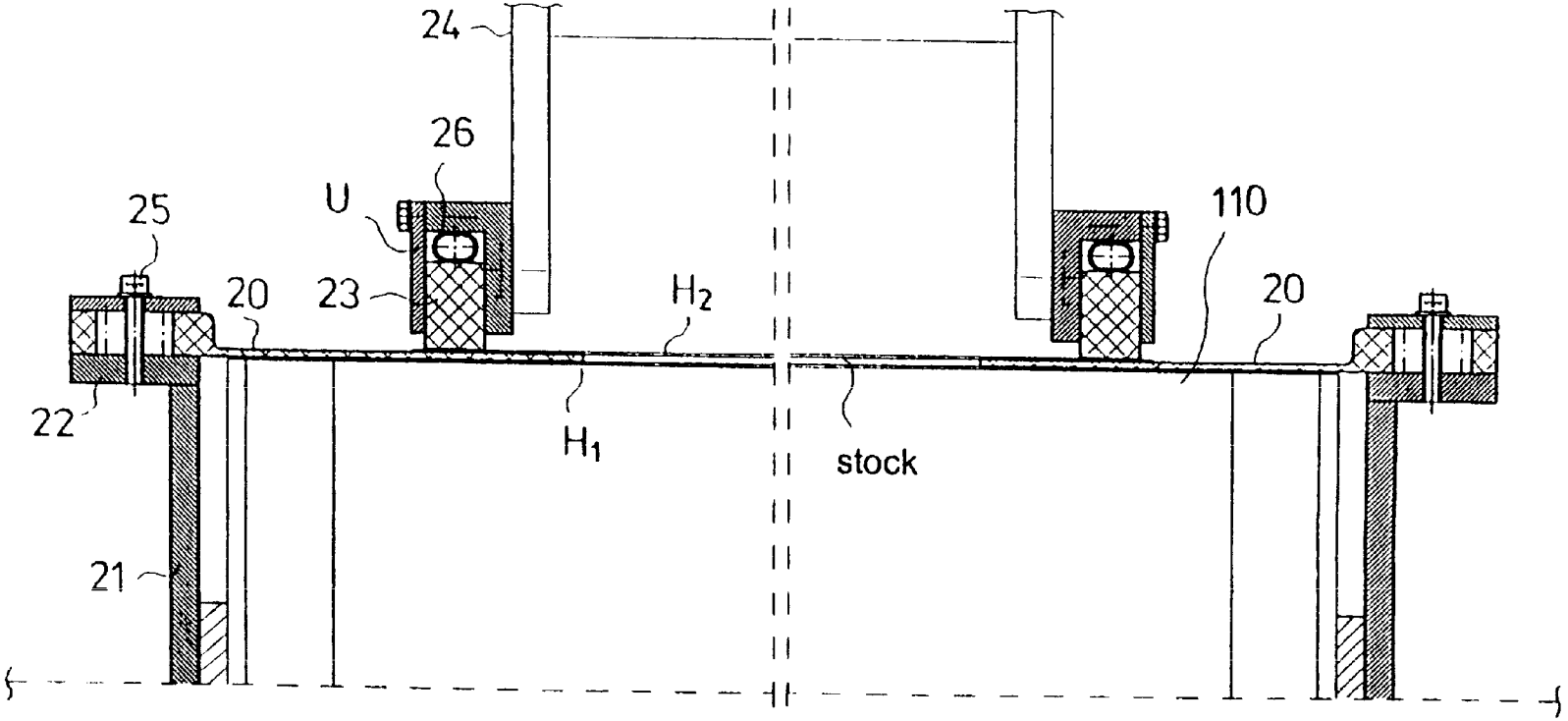
FIG. 5B is a sectional view taken along the line III—III in FIG. 5A.

FIG. 5B is a sectional view taken along the line III—III in FIG. 5A. As is shown in FIG. 5B, the ribs 20 have been fitted at both sides of the suction box 110, and they are supported on the suction box frame 111 by means of support arms 21. Thus, when the former. roll 11 is used, the support of the rib takes place by the intermediate of the support arms 21, favourably on the axle 11*a* or the bearing means $G_1$, $G_2$ of the former roll 11, and, when the suction box 110 is used, the support of the ribs 20 takes place on the frame of the suction box.

The support and the sealing of the rib 20, both with a suction box 110 and with a former roll 11, are similar to those shown in the embodiments shown in earlier illustrations. Thus, also in the case of the former roll 11, the covering wire $H_2$ is fitted to run so that the separate seal 23 is pressed with the force of the loading hose against the covering wire $H_2$ while the covering wire is placed between the top face 20*a* of the rib 20 and the face of the seal 23, as is shown in FIG. 4C.

Figure 6A:
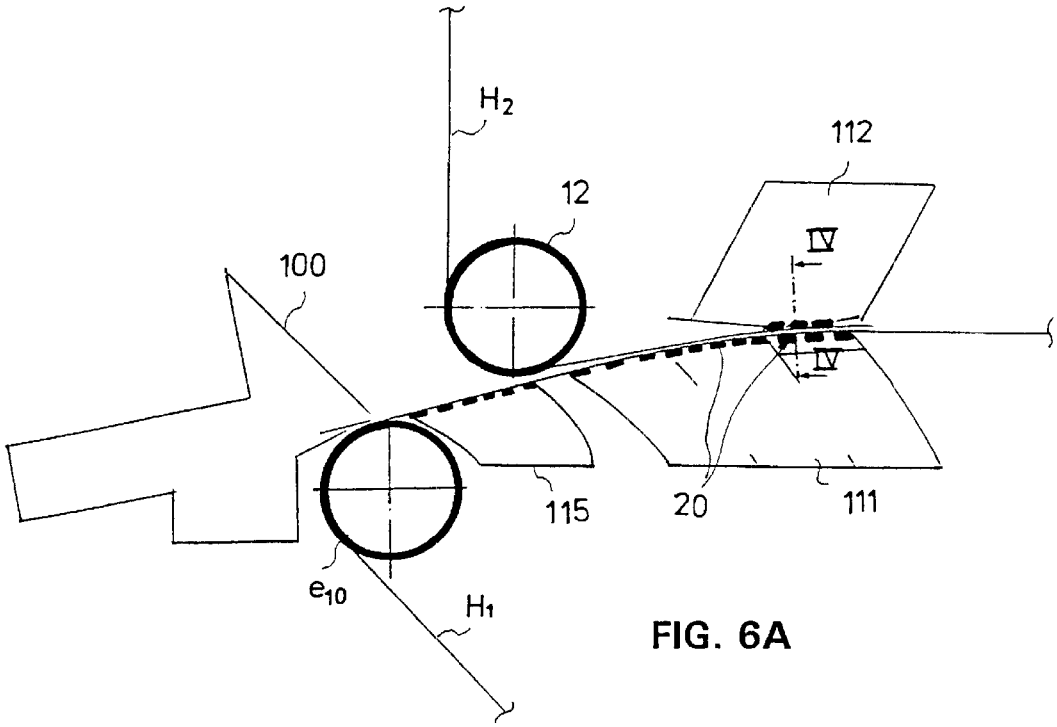
FIG. 6A illustrates the use of a rib in accordance with the invention in connection with a twin-wire web former of a different type.

FIG. 6A shows the use of a rib 20 in accordance with the invention in connection with a former which comprises a separate drain unit 115 before the suction box 111 meant for water draining. Further, above the wire $H_2$, there is a suction box 112 intended for draining of water. As is shown in the figure, in the twin-wire former shown in the figure, the forming wire $H_1$ is passed over the reversing roll $E_{10}$ from the vicinity of the headbox 100 over the suction boxes 115 and 111, which are preferably ribbed suction boxes. Similarly, the forming wire $H_2$ is passed over the reversing roll 12, so that, in the area in which the forming wires $H_1$ and $H_2$ reach contact with each other, a rib 20 in accordance with the invention is used at the edges of the runs of the forming wires. From the headbox 100, the stock suspension is passed into connection with the forming wire $H_1$, along with which the stock suspension moves, as is the case in the former embodiments, into the gap between the forming wires $H_1$ and $H_2$ and further to the scope of the effect of the ribbed suction boxes 111 and 112, however, so that first the stock suspension is processed in connection with a pre-drain unit, i.e. with a ribbed suction box 115 as shown in the figure, before it is passed to between the forming wires $H_1$ and $H_2$.

Figure 6B:
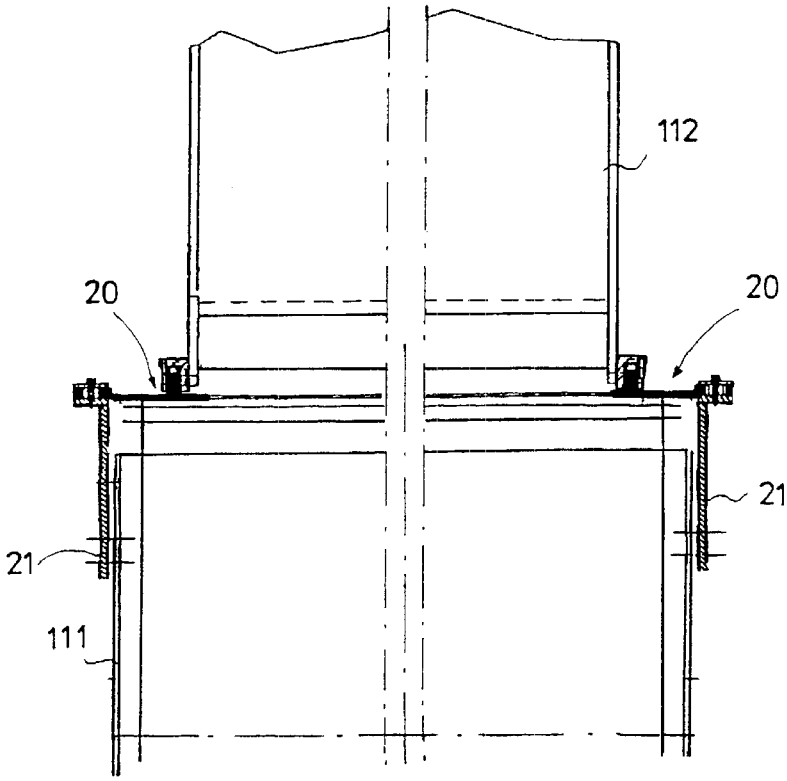
FIG. 6B is a sectional view taken along the line-IV—IV in FIG. 6A.

FIG. 6B is a sectional view taken along the line IV—IV in FIG. 6A. As is shown in FIG. 6B, ribs in accordance with the invention have been fitted in the lateral areas at both sides of the runs of the forming wires. The construction. is similar to that shown in FIG. 4C, however, so that the former roll is also in this embodiment substituted for by a ribbed suction box 111. Thus, the present invention is suited for different twin-wire web formers.

What is claimed is:

1. An equipment in a twin-wire former, in which a partly pre-drained or non-drained fibre stock is passed to between first and second forming wires ($H_1$, $H_2$) of the web former in the vicinity of the former roll (11) or of a water drain box (110), in which connection water is drained out of the stock web by means of the former roll (11) or the water drain box (110), wherein the twin-wire former comprises:

a rib (20) in connection with the former roll (11) or the water drain box (110) in the lateral area of the wires ($H_1$ and $H_2$), which rib has been fitted to control the running of the second forming wire ($H_2$) passed from a gap roll (12), and by means of which rib (20), in the lateral area of the wire runs, the point at which said second forming wire ($H_2$) reaches contact with the first forming wire ($H_1$) in connection with the former roll (11) or the water drain box (110) is shifted further away in the machine direction, and that the rib (20) is an oblong structure, which has a maximal height ($H_{max}$) in the area between an inlet end ($H_{in}$) of the rib (20) and an outlet end ($H_{out}$) of the rib (20), in which case the thickness of the rib is increased when proceeding from the inlet end ($H_{in}$) of the rib to the position of maximal height ($H_{max}$) of the rib, and the thickness of the rib is lowered when proceeding from the position of maximal height ($H_{max}$) of the rib to the outlet end ($H_{out}$) of the rib.

2. An equipment as claimed in claim 1, wherein the height ($H_{in}$) of the rib at the inlet side is in a range of about 1 to 5 mm, and the height ($H_{out}$) of the rib at the outlet side is in a range of about 1 to 5 mm, and that the maximal height ($H_{max}$) of the rib in the middle area of the rib is in a range of about 5 to 30 mm.

3. An equipment as claimed in claim 1, wherein the location of the rib (20) in the running direction of the wires is such that the starting point of the rib is at the earliest in the area ($B_1$) in which the wires reach contact with each other, and the end point of the rib is at the latest in an area in which the thickness of the web is less than 1 mm.

4. An equipment as claimed in claim 1, wherein the rib (20) has been attached to a frame of the machine by means of screws ($R_1$; $R_5$), in which connection the position of the rib (20) in the machine direction can be regulated by means of the screws ($R_1$).

5. An equipment as claimed in claim 1 wherein the rib (20) comprises:

fastening means by whose fastening means the position of the rib (20) in the cross direction of the machine can be regulated.

6. An equipment as claimed in claim 1, wherein the rib (20) has been fitted to become narrower in the cross machine direction when proceeding in the running direction of the wire.

7. An equipment as claimed in claim 1, wherein the rib (20) has been fitted to become wider in the cross machine direction when proceeding in the running direction of the wire.

8. An equipment as claimed in claim 1, wherein, in connection with the rib, there is a seal (23), which can be pressed with the pressure of one of an actuator and a loading hose (26), towards the rib (20) so that the forming wire ($H_2$) remains between the rib (20) and the seal (23).

9. An equipment as claimed in claim 8, wherein the loading hose (26) and the seal (23) have been fitted in a groove (U) in an upper frame (24), and the loading hose and the seal (23) have been fitted substantially over the entire length of the rib (20).

10. An equipment as claimed in claim 1, wherein the shape of the rib (20) can be varied so that the height of the rib (20) can be regulated by means of an actuator (70).

11. An equipment as claimed in claim 1, wherein the position/shape of the side face of the rib (20) is regulated by means of an actuator (700).

12. An equipment as claimed in claim 8, wherein the actuators comprise loading hoses which have been fitted inside the rib (20).

13. An equipment as claimed in claim 1, wherein the ribs (20) have been supported by means of support arms (21) on an axle (11*a*) or bearings ($G_1$) of the former roll (11) or supported on the frame (11) of the suction box.

14. An equipment as claimed in claim 1, wherein the twin-wire former is a gap former (10).

15. A method in the regulation of a rib (20) which rib has been fitted to control the running of a second forming wire ($H_2$) passed from a gap roll (12), and by means of which rib (20), in the lateral area of the wire runs, the point at which said second forming wire ($H_2$) reaches contact with a first forming wire ($H_1$) in connection with a former roll (11) or a water drain box (110) is shifted further away in the machine direction, and that the rib (20) is an oblong structure, which has a maximal height ($H_{max}$) in the area between an inlet end ($H_{in}$) of the rib (20) and an outlet end ($H_{out}$) of the rib (20), in which case the thickness of the rib is increased when proceeding from the inlet end ($H_{in}$) of the rib to the position of maximal height ($H_{max}$) of the rib, and the thickness of the rib is lowered when proceeding from the position of maximal height ($H_{max}$) of the rib to the outlet end ($H_{out}$) of the rib, said method comprising the step of:

altering a position of one of a top face (20*a*) of the rib (20) and a position of a side face (20*b*) of the rib (20) by means of an actuator (70, 700).

* * * * *